US010323909B2

(12) United States Patent
Carton et al.

(10) Patent No.: US 10,323,909 B2
(45) Date of Patent: Jun. 18, 2019

(54) BLAST-PROTECTION ELEMENT

(71) Applicant: Nederlandse Organisatie voor toegepast-natuurwetenschappelijk onderzoek TNO, The Hague (NL)

(72) Inventors: Erik Peter Carton, The Hague (NL); Geert H. J. J. Roebroeks, The Hague (NL)

(73) Assignee: NEDERLANDSE ORGANISATIE VOOR TOEGEPAST-NATUURWETENS CHAPPELIJK ONDERZOEK TNO, The Hague (NL)

( * ) Notice: Subject to any disclaimer, the term of this patent is extended or adjusted under 35 U.S.C. 154(b) by 0 days.

(21) Appl. No.: 15/039,049

(22) PCT Filed: Nov. 27, 2014

(86) PCT No.: PCT/EP2014/075865
§ 371 (c)(1),
(2) Date: May 25, 2016

(87) PCT Pub. No.: WO2015/078996
PCT Pub. Date: Jun. 4, 2015

(65) Prior Publication Data

US 2017/0176149 A1 Jun. 22, 2017

(30) Foreign Application Priority Data

Nov. 27, 2013 (NL) ..... 2011848

(51) Int. Cl.
*F41H 7/04* (2006.01)

(52) U.S. Cl.
CPC ..... *F41H 7/042* (2013.01)

(58) Field of Classification Search
CPC ..... F41H 7/042; F41H 7/044; F41H 7/02; F41H 5/06; F42D 5/045
(Continued)

(56) References Cited

U.S. PATENT DOCUMENTS 1,149,127 A * 8/1915 Giem ..... F41A 23/34 89/36.08
3,765,299 A * 10/1973 Pagano ..... F41H 5/0442 89/36.08

(Continued)

FOREIGN PATENT DOCUMENTS

EP 2327950 A2 10/2010
WO 2008127272 A1 10/2008

OTHER PUBLICATIONS

International Search Report for International Application No. PCT/EP2014/075865 (dated Feb. 2, 2015) (3 pages).

*Primary Examiner* — Joshua E Freeman
*Assistant Examiner* — Bridget A Cochran
(74) *Attorney, Agent, or Firm* — Lucas & Mercanti, LLP

(57) ABSTRACT

A blast-protection element for protecting a vehicle against a blast is disclosed. It includes a deformable impact section which has a blast facing surface, at least one apex part and at least two blast-guiding parts. The blast-guiding parts extend at opposed sides of the apex part, and the apex part further includes a protruding apex in the blast facing surface. The blast-guiding parts each include a concave portion of the blast-facing surface and the blast guiding parts in total span at least 75% of the width of the impact section and more than 90% of the blast-facing surface of each of the blast-guiding parts is concave.

17 Claims, 6 Drawing Sheets

(58) Field of Classification Search
USPC ..... 89/36.08, 36.01, 36.02, 36.17
See application file for complete search history.

(56) References Cited

U.S. PATENT DOCUMENTS 4,316,286 A * 2/1982 Klein ..... F41H 5/0492 109/49.5
5,533,781 A * 7/1996 Williams ..... B62D 25/2072 296/204
7,228,927 B2 * 6/2007 Hass ..... B60K 6/46 180/65.25
7,540,229 B2 * 6/2009 Seo ..... F41H 5/007 89/36.02
7,698,985 B2 * 4/2010 Tapp ..... F41H 5/013 89/36.02
7,997,182 B1 * 8/2011 Cox ..... F41H 7/042 296/187.07
8,033,208 B2 * 10/2011 Joynt ..... F41H 7/042 296/187.07
8,146,477 B2 * 4/2012 Joynt ..... F41H 7/042 296/187.07
8,365,649 B1 * 2/2013 Andrews ..... F41H 7/042 428/911
8,424,443 B2 * 4/2013 Gonzalez ..... F41H 7/042 296/187.07
8,454,082 B2 * 6/2013 Medwell ..... F41H 7/04 296/193.03
8,740,286 B2 * 6/2014 Aizik ..... F41H 7/042 296/187.07
8,776,663 B1 * 7/2014 Berman ..... F41H 7/048 89/36.08
8,943,946 B1 * 2/2015 Richmond ..... F41H 7/044 89/36.02
9,829,282 B1 * 11/2017 Richmond ..... F41H 7/044
2003/0010189 A1 * 1/2003 Zonak ..... F41H 7/042 89/36.08
2007/0084337 A1 * 4/2007 Strassgurtl ..... F41H 7/042 89/36.08
2007/0186762 A1 * 8/2007 Dehart ..... F41H 5/023 89/36.09
2007/0234896 A1 * 10/2007 Joynt ..... F41H 7/042 89/36.09
2008/0034953 A1 * 2/2008 Barbe ..... F41H 7/042 89/36.01
2010/0000399 A1 * 1/2010 Barnes ..... E04H 9/10 89/36.02
2010/0218667 A1 * 9/2010 Naroditsky ..... F41H 7/042 89/36.02
2011/0088544 A1 * 4/2011 Bettencourt ..... F41H 7/042 89/36.08
2011/0138994 A1 * 6/2011 Joynt ..... F41H 7/042 89/36.08
2011/0314999 A1 * 12/2011 Luther ..... F41H 7/042 89/36.02
2012/0174767 A1 * 7/2012 Naroditsky ..... F41H 7/042 89/36.08
2012/0180632 A1 * 7/2012 Hunn ..... F41H 7/042 89/36.02
2012/0192708 A1 * 8/2012 Kocher ..... F41H 7/042 89/36.08
2012/0210861 A1 * 8/2012 Tobie ..... F41H 5/007 89/36.04
2012/0247315 A1 * 10/2012 Treadway ..... F41H 7/042 89/36.02
2013/0014635 A1 * 1/2013 Kosheleff ..... F41H 7/042 89/36.02
2013/0036899 A1 * 2/2013 Tucker ..... F41H 7/042 89/36.02
2013/0312595 A1 * 11/2013 Lee ..... F41H 7/042 89/36.02
2014/0060300 A1 * 3/2014 Kucherov ..... F42D 5/05 89/36.02
2014/0060303 A1 * 3/2014 Enck ..... F41H 7/042 89/36.02
2014/0311330 A1 * 10/2014 Parida ..... F41H 7/042 89/36.08

* cited by examiner

| FLAT (comparative) | V (comparative) | GULL | GULL-LOW |
|---|---|---|---|
|  |  |  |  |

BLAST-PROTECTION ELEMENT

CROSS-REFERENCE TO RELATED APPLICATIONS

This application is a 371 of PCT/EP2014/075865, filed Nov. 27, 2014, which claims the benefit of Dutch Patent Application No. 2011848, filed Nov. 27, 2013.

FIELD OF THE INVENTION

The invention relates to a blast-protection element for a vehicle, a land vehicle, and a method of manufacturing a land vehicle. Preferably, the blast-protection element is for increased protection against land mines and/or improvised explosive devices for armoured land vehicles.

BACKGROUND OF THE INVENTION

Explosive devices such as improvised explosive devices (IED) and land mines pose a threat to armoured land vehicles. Such explosive devices are typically placed on the ground, just above ground level or can be buried. Encountering of an explosive device by a land vehicle can trigger the device to explode under the vehicle and thus an under-vehicle blast. Such a blast can cause injuries or death of passengers of the vehicle and damage to the vehicle and cargo. This is not only because the floor of the vehicle can break, so that hot gasses, debris, shrapnel and floor fragments can enter the cabin, but also because of the impact due to the blast. The sudden acceleration of the vehicle can cause a shock to a passenger, which can cause brain injuries, spine injuries and other visible and invisible trauma. The vehicle may also roll-over due to a blast. The risk thereof increases with a higher centre of gravity of the vehicle.

In recent conflicts, IEDs are more frequently deployed and have increased explosive strength. Protective measures for armoured vehicles against under-vehicle blasts have therefore become more important. However, at the same time, high manoeuvrability and reduced weight are important requirements for armoured vehicles, for example to allow their use in urban environments. For these reasons, a need exists for protective measures for vehicles against blasts which allow a vehicle to remain relatively light-weight and highly manoeuvrable.

Traditionally, armoured vehicles are provided with a flat floor. Stiff structures are used to carry loads from blasts from under-vehicle mines. The stand-off of the vehicle (distance between ground-level and vehicle bottom) is kept as large as possible. The blast pressure is received by the vehicle bottom, resulting in deformations, which are desired to be limited. Recently, V-shaped hulls have been used for improved protection against IEDs. For example, Stryker vehicles have been manufactured and retrofitted with a V-hull for improved performance against IEDs compared to the traditional flat-bottom configuration. The downward pointing V-shaped geometry is intended to deflect upward propagating blasts occurring under the vehicle. An exemplary V-shaped (or diamond-shaped) hull design is disclosed in US-A-2007/0 186 762. A disadvantage of V-shaped hulls is that a vehicle provided with such a hull generally has a higher centre of gravity of the vehicle, which increases the risk of roll-over of the vehicle.

U.S. Pat. No. 8,365,649 relates to a composite armour assembly having a convex downward-facing centre surface and concave downward-facing sides, in particular FIGS. 1A and 4E. The major convex centre part results in worse pulse transfer and limited or no membrane forces under blast loading. US-A-2011/0 088 544, FIG. 3, relates to an armour plate with side walls in the form of concave chutes, and a broad flat plate in the centre. WO-A-2008/127272 relates to a stepped V-shaped bottom hull for an armoured vehicle, in particular FIGS. 1B and 2.

US-A-2012/0 247 315 describes a blast-protection element for a land vehicle having an exterior impact surface defining a cross-sectional profile defining a smooth continuous curve, wherein the exterior impact surface is convex. The blast-protection element is, when in use attached to the vehicle, oriented convexly relative to the ground plane. A disadvantage of such a blast-protection element is that it is almost horizontal next to its centreline. Blasts occurring near the centreline are thus not efficiently deflected sideward.

US-A-2007/0 084 337 describes a vehicle under-structure comprising an inwardly bent downwardly concave armoured bottom plate mounted on a bottom of a vehicle, the bottom plate being formed with at least one bending edge extending longitudinally with respect to the vehicle.

US-A-2003/0 010 189 describes a concave, homogenous protective floor plate having a large radius for an armoured vehicle.

US-A-2011/0 314 999 disclosed a curved underbelly device for an armoured vehicle including curvilinear, saddle and sinusoidal shapes.

Gurumurthy, "*Blast mitigation strategies for vehicles using shape optimization methods*", master thesis MIT, September 2008, http://hdl.handle.net/1721.1/45759, describes the 2D modelling of the flow of a blast wave around a vehicle with a vehicle hull, including a concave hull, simulated as a non-deformable solid object and having a half consisting of a quarter circle. It was observed that a V-shape showed the best performance over all blast intensity levels in terms of minimising the peak head-on impulse.

BIPS 06/FEMA 426: Reference Manual to Mitigate Potential Terrorist Attacks against Buildings, 2nd Edition, October 2011, describes that when an incident pressure wave impinges on a structure that is not parallel to the direction of the wave's travel, it is reflected and reinforced. This results in the structure being exposed to a reflected pressure that is greater than the incident pressure (or side-on pressure). The reflected pressure varies with the angle of incidence of the shock wave and is typical maximal when shock wave impinges on a perpendicular surface (angle of incidence of 0°), is minimum when the surface is parallel (angle of incidence) 90° and has a maximum due to Mach reflections around 45°. The coefficient of reflection is typically 2-13.

An alternative approach to protect against blasts is to install suspended seats and energy absorbing materials.

Problems associated with known blast-protection element include a large impulse transmitted to the vehicle from a blast and large deformation of the blast-protection element by blasts. In addition, the known blasts shields do not optimally use the tensile strength of the material they are made of.

SUMMARY OF THE INVENTION

An objective of the present invention is to provide a blast-protection element that mitigates one or more of the above mentioned problems at least in part. The inventors found that this objective can at least in part be met by a blast-protection element having a specific design comprising concave elements.

In an aspect, the invention relates to a blast-protection element for protecting a vehicle against a blast, said blast-protection element comprising a deformable impact section, wherein said impact section comprises a blast-facing surface, at least one apex part and at least two blast-guiding parts, wherein said blast-guiding parts extend at opposed sides of said apex part, wherein said apex part comprises a protruding apex in said blast-facing surface and wherein said at least two blast-guiding parts each comprise a concave portion of said blast-facing surface wherein the blast guiding parts in total span at least 75% of the width of the impact section, and wherein more than 90% of the blast-facing surface of each of said blast-guiding parts is concave.

DETAILED DESCRIPTION OF THE INVENTION

Figure 1:
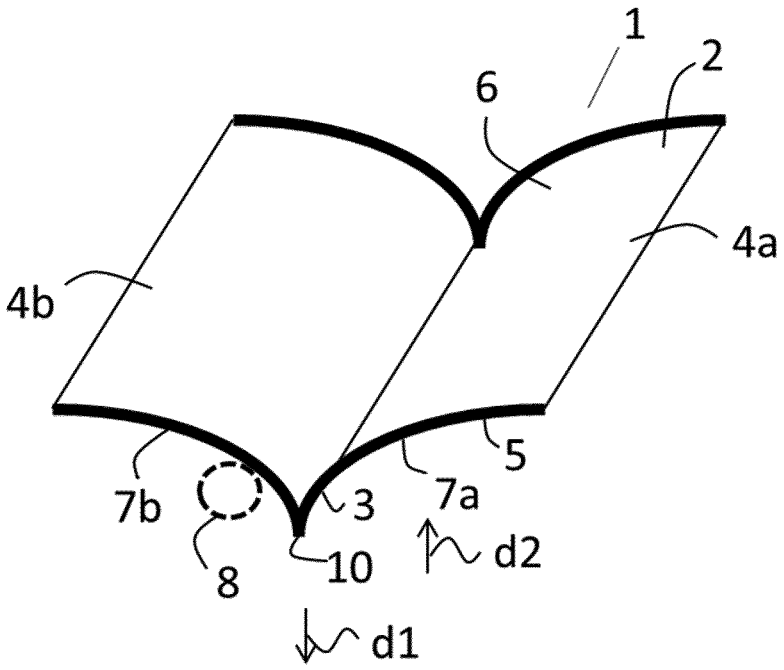
FIG. 1 is a schematic representation of a blast-protection element as described herein.

The term "blast" as used in this application includes a shock-wave due to an explosion comprising highly compressed air, propagating radially outward from a source at supersonic velocities.

The term "blast-protection element" as used in this application refers to a device or part that serves as a protective cover or barrier for an object at one side of the blast-protection element against a blast (shockwave of an explosion) impacting the object.

The term "monolithic" as used in this application refers to an object that is a single, unitary piece formed of a material without joints or seams.

The term "apex" as used in this application refers to a protruding part, such as an outward bulging extreme, for example a cusp or tip. An apex includes in particular a convex fold in an element wherein the fold extends as a line in a direction. An apex is typically not formed by a recess.

The term "smooth" as used in this application indicates that a surface is continuous and even. Such a surface typically lacks projections or indentations.

The term "concave" as used in this application refers to a surface that is curving inward as opposed to convex, at least in one direction. The term concave is not restricted to describing a surface with a constant radius of curvature, but rather is used to denote the general appearance of the surface. The term "concave" includes single concave (e.g. as in a hollow cylinder), a saddle curvature and double concave (e.g. as in a hollow sphere).

The term "transversal cross-section" as used in this application refers to a cross-section in the plane perpendicular to the longitudinal direction. Such cross-section is typically in the plane perpendicular to a line defined by the apex. Where a certain profile in a transversal cross-section is described, in principle such a profile in any cross-section will work.

The term "concave blast-guiding part profile section" as used herein refers to a concave section of a transversal cross-sectional profile corresponding to a blast-guiding part of the blast-facing surface of the impact section The term "deformable" as used in this application refers to deformation under blast conditions. In particular, deformable relates to objects and/or materials with a finite Young's modulus, typically a Young's modulus of 5 GPa to 500 GPa, for example 20 GPa to 230 GPa. In addition, a deformable object and/or material typically have a yield stress of 10 MPa to 5000 MPa, such as 180 MPa to 2000 MPa. Typically, a deformable object has a defined, finite ultimate strength that is higher than its yield stress by preferably at least 5% of the yield stress and typically is in the range of 30 MPa to 7000 MPa, such as 200 MPa to 2000 MPa. Nevertheless, fibre-reinforced materials not having a yield stress are also deformable materials.

An important advantage of the blast-protection element is the improved stiffness when subjected to a blast load, due to the curved shape.

A further advantage of the blast-protection element of the present invention is improved protection against blasts; resulting in reduced impulse transmitted to the vehicle and/or reduced deformation.

In addition, the design of the blast-protection element allows deflecting a blast to the sides of the blast-protection element. An advantage of this is that secondary blast reflections from the ground are reduced.

Moreover, the design of the present invention allows reducing the reflected pressure at parts of the blast-protection elements close to the source of the blast by having an optimal angle of incidence at these parts. The blast-protection element combines the constructive response to a blast and the stiffness of a curved plate with a reduced reflected pressure at the apex. The choice of the angle at the apex allows a reduction of the coefficient of reflection from 10 to a lower value in the range of 3 to 5.

The blast-protection element provides as additional advantage that deformation of the impact section at each side of the apex can be reduced. As the element comprises concave blast-facing surface portions, the impact section deforms less under the pressure wave of a blast, in comparison to a conventional flat or V-shaped blast-protection element, and to elements with large convex parts, and/or large non-concave centre parts. The main deformations of the blast-protection element according to the invention are primarily in the form of membrane deformations involving tensile stress (membrane stress) with limited shear stress and limited out-of-plane (plate) bending. This differs from current elements (in particular vehicle floors) consisting in large parts of single or multiple flat sections, or having large convex parts, which mainly deform under bending, resulting in severe shear loading. Such shear loading causes as disadvantage considerable larger deformation of the element, potentially threatening for example passengers of a vehicle provided with the element. Hence, the impact section acts preferably at least partially as a shell, resisting the blast at least partly by membrane action.

The blast-protection element is suitable for a vehicle. The blast-protection element can comprise a vehicle floor or base plate; or can form a part thereof. The blast-protection element can be used for land-mine and/or IED protection for armoured land vehicles.

The blast-protection element comprises an impact section. The impact section can comprises a part adapted for resisting and/or deflecting at least partly a blast, such as a blast occurring at least partly under a vehicle. The impact section is preferably massive and is preferably formed by a curved plate.

In addition to an impact section, the blast-protection element can comprise means for attaching the blast-protection element to a vehicle. The attachment can be for example demountable or permanent. The blast-protection element however may also form an integral part of a vehicle.

The impact section comprises a blast-facing surface. The blast-facing surface can also be referred to as exterior surface. The blast-facing surface of the impact section comprises the blast-facing surface of the various parts of the impact section that have an exposed surface at the blast-facing side. In use, such as mounted on a land vehicle, the blast-facing surface is typically oriented towards the ground plane, in other words faces the ground.

The impact section typically has an interior surface at an interior side opposed to a blast-facing surface at the blast-facing side. An object to be protected by the blast-protection element, such as the vehicle cabin, is located at the interior side. The impact section typically comprises in addition an edge. The edge can comprise two opposed side edge parts and a front and rear side edge part opposed to each other. In use the edge parts can be positioned at the corresponding sides of the vehicle. The edge of the impact section typically defines a datum.

The blast-protection element has a length, width and height and a corresponding longitudinal, transversal (lateral) and vertical direction and axis. When used for protecting a vehicle, the longitudinal direction extends parallel to the lengthwise axis of the vehicle (front-rear); the transversal or lateral direction extends perpendicular to the longitudinal direction and generally parallel to the ground plane and the vertical direction extends perpendicular to the ground plane. Accordingly, in terms of the roll-pitch-yaw convention, roll is around the longitudinal axis, pitch around the transversal axis and yaw around the vertical axis.

The height of the blast-protection element refers to the maximal dimension (span) in vertical direction at the blast-facing side. The depth of impact section refers to the difference in vertical position between the interior side of the impact section and the side ends of the impact section. The impact section also has a thickness, measured in vertical direction.

The width of the blast-protection element is preferably 200 cm to 300 cm, such as 2.1 m to 2.5 m. The length of the blast-protection element is typically 2 m to 8 m, such as 3 m to 6 m. The height of the blast-protection element, or impact section, is typically 20 cm to 100 cm, such as 25 cm to 75 cm, such as 30 cm to 50 cm.

The impact section comprises at least one apex part. The apex part comprises a blast-facing surface and comprises in its blast-facing surface a protruding apex. The impact section can comprise one, two or three apex parts or even more apex parts, each comprising an apex in the blast-facing surface.

The apex part can be positioned at a centred transversal position of the impact section. An example of a centred transversal position of the impact section is between 40-60% of the width of the impact section.

Preferably an apex part extends in longitudinal direction, preferably over more than half of the length of the blast-protection element. Preferably, an apex part is stiff, such as reinforced. An apex part extends over the thickness of the impact section and has preferably a larger thickness than the blast-guiding parts, such as 150% or more or 200% or more of the thickness of the blast-guiding parts. Such preferred apex part can provide a stiff spine of the blast-protection element.

Possible forms for the blast-facing surface of an apex part and/or an apex include convexly curved, flat and edged. An apex is typically formed by the part of the blast-facing surface of the impact section between the concave blast-facing surface portions of two blast-guiding parts. An apex part is preferably non-concave. An apex part preferably spans less than 5% of the width of the impact section, such as 1% or less. The apex is preferably sharp.

Preferably, an apex part comprises, or is formed by, a corner edge (such as a ridge) and the at least two blast-guiding parts are adjacent to the apex part, at opposed sides adjoined to each other at the corner edge. The corner edge can extend in longitudinal direction, preferably over a majority the length of the impact section, preferably over substantially the entire length (90% or more) of the impact section. The corner edge can be straight and in longitudinal direction. The impact section can comprise only one edge.

Preferably, an apex part comprises two surfaces at angle in transversal direction and adjoined to each other at a corner edge extending in longitudinal direction, wherein in the surfaces are at an angle of 60° or less, such as 45° or less to the vertical direction.

The impact section comprises at least two blast-guiding parts, such as two, three, four or more blast-guiding parts. The at least two blast-guiding parts extend at opposed sides of an apex part, preferably at two sides opposed in transversal direction.

The blast-guiding parts can guide a blast at least partly to the (side) edges of the impact section and thus to sides of the blast-protection element. Accordingly, the blast-guiding parts can guide an under-vehicle blast at least partly to the sides of a vehicle.

The blast-guiding parts and/or apex part can be structurally integrated, such as in case of a monolithic impact section. The blast-guiding parts and/or apex part can also be structurally separate elements of the impact section.

The blast-guiding parts span the width of the impact section at least partly. The blast guiding parts in total span at least 75% of the width of the impact section, preferably as 90% or more, typically up to 95% of the width. Accordingly, an apex part can be thin and span (in total for all apex parts) less than 25% of the width of the impact section, such as 10% or less or 5% or less.

The at least two blast-guiding parts each comprise a concave blast-facing surface portion. Accordingly, each of the at least two blast-guiding parts has a blast-facing surface comprising a portion that is concave. Both a concave blast-facing surface portion and an apex lie in a blast-facing surface of the impact section. A concave blast-facing surface portion accordingly lies at the same blast-facing side of the impact section as an apex.

Each blast-guiding part comprises a concave blast-facing surface portion. More than 90% of the blast-facing surface, of the blast-guiding part is concave, of each blast-guiding part. Preferably, substantially the entire blast facing surface is concave, preferably for each blast-guiding part.

The concave curvature of the concave blast-facing surface portion provides as advantage over convex parts and over faceted blast-guiding parts with few facets and large kinks, that stress caused by the impact of a blast is dispersed in the blast-guiding part, as in a membrane. The concave blast-facing surface portion thus advantageously avoids concentration of shear stresses and stresses in edges. The loads are transferred in-plane to the sides of the blast-guiding parts. The concavity provides as advantage that, in use, the part of blast-facing surface close to the edge can have a large stand-off, allowing a blast to exit, while the blast-facing surface close to the apex can have an oblique angle to a blast that provides an advantageous reflection coefficient for a blast wave. In this way, design of the concave blast-facing surface portion can contribute to deflecting a blast occurring under a vehicle.

A concave blast-facing surface portion thus has at least one osculating circle at the blast-facing side. Accordingly, a concave-blast facings surface portion has a radius of curvature in at least one direction. The osculating circle is preferably in the plane of a transversal cross-section (perpendicular to the longitudinal axis). Preferably a blast-guiding part, preferably all, has a blast-facing surface with a portion with at least one negative principal curvature. The entire blast-facing surface can have at least one negative principal curvature, preferably in the vertical direction.

The concave blast-facing surface portion preferably has a radius of curvature between 10% and 5000% of the width of the blast-protection element (degree of concavity), such as, within this range, 10% or greater, 50% or greater, 70% or greater, 100% or greater, 2000% or less, 1000% or less, 500% or less. The radius of curvature of the concave blast facing surface portion is finite and defined; otherwise the blast-facing surface portion is not concave.

The concave blast-facing surface portion of a blast-guiding part can have such degree of concavity that for any first point at the blast facing surface in this surface portion, it comprises a second point in that same surface portion at a distance of 50 cm or less (chord length), such that the distance from the midpoint of the chord between the two points to the surface, taken perpendicular to the chord (versine measurement), is preferably more than 1 cm, such as 2 cm or more, or 4 cm or more. The chord midpoint lies preferably outside the blast-guiding part to the blast-facing side. Preferably, the first and second points lie in the same transversal cross-sectional plane (at the same longitudinal position). Accordingly, the concave blast-facing surface portion can comprise small convex nubs of e.g. less than 5 mm, that do not affect the concavity as measured with a chord of 50 cm or less. The concave blast-facing surface portion can even be dimpled (as an inverse golf ball surface). The concave blast-facing surface portion can also be faceted with many facets and small kinks to approach the curvature. Preferably, the blast-facing surface of the impact section is concave over more than 60% of its surface, such as 80% or more or 90% or more; with a degree of concavity as described. The blast-facing surface portion preferably has a negative mean curvature. Accordingly, the blast-facing surface of the blast-guiding part can be more concavely curved in the transversal cross-section than curved in longitudinal direction.

Preferably, the impact-section has a constant thickness. Preferably, the impact section has a mid-plane (plane defined by half of the thickness) with a concave curvature as is preferred for the blast-guiding surface. This provides improved stiffness compared to a flat and other plates by virtue of the membrane forces within the impact section.

FIG. 1 schematically shows an exemplary embodiment of a blast-protection element. Blast-protection element 1 comprises impact section 2. Impact section 2 comprises apex part 3 and blast-guiding parts 4*a* and 4*b* extending at opposed sides of apex part 3. Impact section 2 has blast-facing surface 5 and optional interior surface 6. Blast-guiding parts 4*a* and 4*b* comprise a blast-facing surface portion 7*a*, respectively 7*b*, which are concave. As a guide to the eye, osculating circle 8 is drawn indicating that blast-facing surface portion 7*b* is concave, as osculating circle 8 lies at the blast-facing side. In addition, apex part 3 comprises apex 10 in blast-facing surface 5. The impact of a blast (not shown) is in direction d2 and apex 10 is pointing in blast-facing direction d1.

Figure 2:
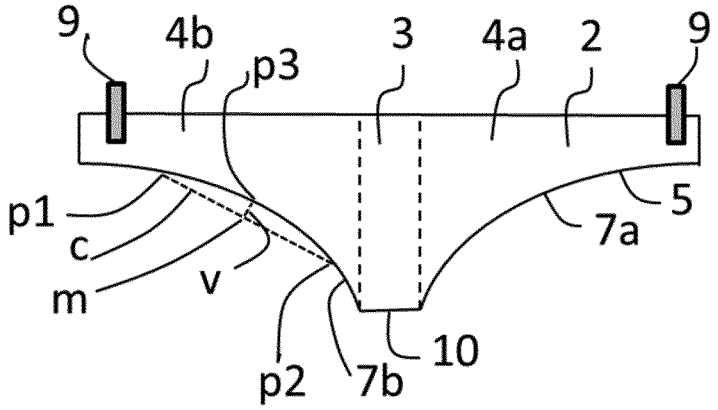
FIG. 2 is a schematic transversal cross-section of a blast-protection element according to the invention.

FIG. 2 schematically shows a transversal cross-section of an exemplary embodiment of a blast-protection element. Apex part 3 extends over the thickness of impact section 2 and comprises apex 10 in blast-facing surface 5. Apex part 10 is a flat non-curved surface part that protrudes in blast-facing surface 5. Apex 5 is a flat surface portion. Blast-protection element 1 comprises means for attachment 9. Concave blast-facing surface portion 7*a* comprises a point p1 and a point p2 defining chord c. Chord c has versine distance v from its midpoint m to point p3 on the blast-facing surface, this versine distance is more than 1 cm, while chord c is less than 50 cm.

Preferably, each of the blast guiding parts can, at least partially, deform as a concave membrane under external blast loading. Accordingly, preferably each blast guiding deforms predominantly through in-plane deformations under external blast loading.

Preferably, the impact section is formed by one or more a deformable sheets, for example deformable bend plates. On impact of a blast, the impact section can in this way deform as a membrane and absorb the load caused by the blast. Preferably, the blast-protection element, in particular the impact section and the deformable sheet, comprises, or is formed of, a deformable material.

Preferably, the impact section is formed of a composite material. In a further preferred option, the impact section is formed of a material comprising a metal or alloy. Particularly preferred is an impact section formed of a fibre metal laminate wherein the fibre metal laminate comprises a laminate of several thin metal layers bonded with layers of fibre-reinforced composite material.

Suitable deformable materials include composite materials and metals, including alloys. Suitable metals include steel, titanium, aluminium and magnesium. Preferably, the composite material is a fibre reinforced material. Examples of suitable fibre reinforcement include glass fibres, carbon fibres, aramide fibres, ultra-high weight polyethylene. Examples of suitable matrix materials include polyurethane, epoxy, polyester, and polyvinylester. Suitable fibre metal laminates include for example glass laminate aluminium reinforced epoxy and central reinforced aluminium (CentrAl®) and aramid aluminium laminate (ARALL®), available from Alcoa, Inc. Fibres are preferably applied at least partly in the direction of the concave curvature and/or as woven material, preferably with the warp in the transversal direction, for optimal benefit of the tensile strength.

A preferred option for materials comprises a combination of different types of materials. Metal can for instance be combined with composite. The metal reinforcement can be between layers of flexible materials or in open spacing between different layers consisting of equal or different materials. Blast-protection elements formed of metal or an alloy may be produced using conventional processes and using techniques such as roll forming, bending. Blast-protection elements formed of a composite material can be made using technologies known in aircraft and ship manufacturing, such as moulding and stamping.

The design of the impact section advantageously allows for benefiting of the tensile strength of the material. Preferably, the impact section is made, at least in part of high-tensile strength materials such as composite materials comprising a fibre reinforcement of aramid fibres, or ultra high molecular weight polyethylene. The impact section can be in the form of as a bent plate or panel. The impact section, in particular blast-guiding parts, can have a substantially uniform thickness. The thickness is optionally 5 mm to 50 mm, such as 10 mm to 30 mm, such as 15 mm to 25 mm, in particular in the case of a steel impact section. For composite concave shapes the material thickness can be significant thicker, such as 10 mm to 300 mm, such as 50 mm to 150 mm.

Optionally, the concave blast-facing surface portion is smooth. For example, the blast-facing surface portion can optionally be free of projections or indentations of more than 30 cm, preferably free of projections or indentations of more than 10 cm. Optionally, the smooth blast-facing surface portion comprises only projections or indentations of no more than 20 cm, such as of 1 cm or less.

The blast facing surface of the impact section can optionally be entirely smooth, such that it does not comprise any hard angles or sharp corners and contains no protrusions or recess of more than 20 cm, preferably more than 10 mm. In addition, the concave blast-facing surface portion can optionally be continuous in position and/or tangential continuous (C1 continuous). This provides the advantage that a blast is deflected more smoothly and/or that stress is dispersed in the blast-guiding part. The blast facing surface can optionally comprise a joint between a blast-guiding part and an apex part. Preferably, the joint is smooth and C1 continuous. This avoids localisation of stress at the joint. Preferably, the impact section is monolithic; preferably also the blast-protection element is monolithic. This advantageously provides improved strength and blast resisting properties compared to non-monolithic impact sections of the same material.

Preferably, the blast-facing surface of the impact section defines a transversal cross-sectional profile comprising an apex between two concave profile sections corresponding to two of the blast-guiding parts. The two concave blast-guiding part profile sections can define an angle (A) outwardly around the apex of preferably more than 180°. Accordingly, the blast-facing surface lies at the outside of the apex.

The concave blast-guiding part profile sections are the sections of the transversal cross-sectional profile (profile sections) defined by concave blast-facing surface portions of blast-guiding parts. Preferably, the two concave blast-guiding part profile sections are directly adjacent to an apex. Angle A is suitably defined by the tangent lines of a point in each of the two blast-guiding part profile sections. As the blast-guiding part profile sections are concave, angle A preferably decreases from apex to side edge of the impact section. Angle A is preferably 180° to 240° at the side ends. At the joints between the apex and the blast-guiding part profile sections, angle A is preferably 340° to 270°. This provides the advantage that blast-facing surface of the impact section close to the apex is relatively sharp and thus faces blast at a large angle having a small coefficient of reflection.

Preferably, the blast-facing surface of the impact section, and in particular the transversal cross-sectional profile thereof, has, in a region adjacent to an apex wherein the vertical distance between the blast-facing surface and the apex is less than 25% of the height of the impact section, an angle of incidence with a blast wave propagating in vertical direction of 45°, more preferably 60° or more.

Herein, an angle of incidence of 0° indicates a wave propagating perpendicular to the surface and an angle of 90° indicates a wave propagating parallel to the surface. In this way, the reflected pressure is minimised at the parts of the impact section close to the apex and generally closer to a blast source. The curvature of the blast-guiding parts allow an increase of the incident angle towards the edges of the impact sections, which are generally further from a blast source. As the angle of incidence determines a coefficient of reflection which is a ratio between the peak reflected pressure and the peak incident pressure, it is most important to minimise the coefficient of reflection where the peak incident pressure is the highest.

For each feature defined in a transversal-cross sectional profile, the impact section preferably has a cross-sectional profile with this feature over 50% or more, such as 75% or more or 90% or more of the length of the impact section.

Figure 3:
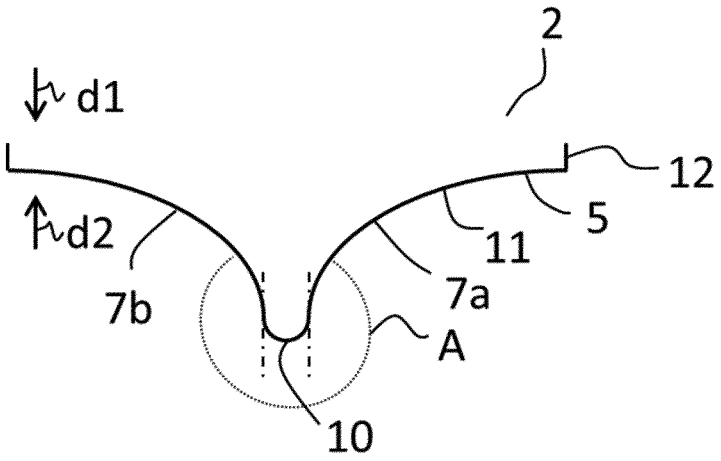
FIG. 3 is a schematic cross-sectional profile of an impact section of a blast-protection element according to the invention.

FIG. 3 schematically shows a cross-sectional profile of an exemplary impact section. Impact section 2 comprises a blast-facing surface 5 defining a cross-sectional profile 11 comprising apex 10 between two concave blast-guiding part profile sections 7*a* and 7*b*. Apex 10 is convexly curved. Blast-guiding part profile sections 7*a* and 7*b* define an angle (arc) A outwardly around apex 10. As profile section 7*b* is part of the profile 11 of the blast-facing surface, its concave curvature is as viewed in direction d2, from the outside of impact section 2, not in direction d1. Accordingly, angle A is as around apex 10 outside impact section 2, not inwardly through impact section 2. Angle A will vary between various parts of concave blast-guiding part profile sections 7*a* 7*b* due to the concave curvature of these parts. Angle A decreases going from apex 10 to side edge 12 of the impact section.

Preferably, an apex is positioned in the centre part of the cross-sectional profile; preferably this is the only apex of the impact section.

The centre part of the cross-sectional profile refers to the centre of the profile of the blast-facing surface of the impact section in a transversal cross-section and the parts of the cross-sectional profile forming 5% of the width of the impact section adjacent at both sides.

The impact section preferably comprises an apex that lies at a distance in the range of 30% to 70%, such as 40% to 60%, of the width of the impact section from the sides of the impact-section, at both sides of the apex, in the transversal cross-sectional profile.

Alternatively, the impact section can comprise two apex parts, one comprising an apex at about a quarter of the width of the impact section from a side edge of the impact section and the other comprising an apex at about a quarter of the width of the impact section from an opposite side edge, each provided with blast-guiding parts at opposed sides of the apex in transversal direction, wherein each blast-guiding part has a width of about a quarter of the width of the impact section. Herein about a quarter of the width includes 20-30% of the width. The impact section can further comprise a joint between the two inner blast-guiding parts.

Preferably, the transversal cross-sectional profile of the blast-facing surface of the impact section is concave of a majority of the arc length of the cross-sectional profile, such as substantially entirely or more than 90% or more than 70% or more than 80%. This provides good blast deflecting properties and dispersion of stresses in the impact section, in particular for advantageous membrane deformation.

Preferably, in the transversal cross-sectional profile, the apex and the ends of the two concave blast-guiding part profile sections define a triangle with an included angle at the apex of 60° to 180°, such as 100° to 150°. In some embodiments, the height of the impact section, alternatively the distance in vertical direction from an apex to a datum defined by the edges of the impact section, is 1-150% of the width of the impact section, such as 5% or more, 10% or more, 30% or more, 50% or more, 100% or less, 75% or less, within this range.

The blast-guiding part profile section can define a smooth, continuous curve, such as positional and tangential continuous (C1 continuous). Preferably, the curve is substantially symmetric at both sides of the apex part. A blast-guiding part profile section can for example define a circular or elliptical arc, such as a circle part.

Figure 4:
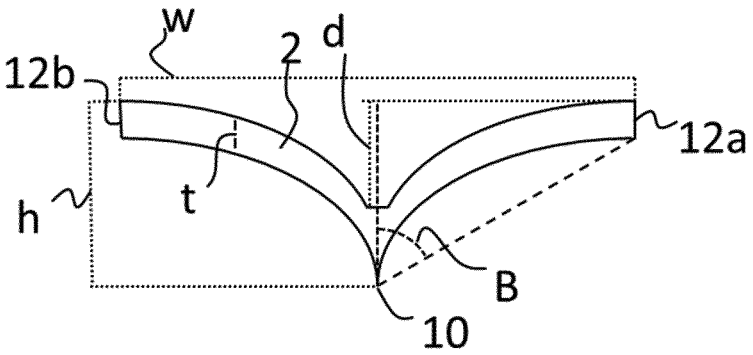
FIG. 4 is a schematic representation of an impact section 2.

FIG. 4 schematically shows an exemplary impact section 2 having a width w, a height h, a depth d and a thickness t. Thickness t is different at various positions in the impact section. Apex 10 and side ends 12*a* and 12*b* define a triangle with included angle B (for clarity only halve angle B is shown).

Preferably, the blast-facing surface of the impact section defines a transversal cross-sectional profile having the general form of an inwardly curved V-shape. The V-shape is preferably curved inwardly such that a chord from the apex to the side ends lies outside the impact section at the blast-facing side. The V-shape is preferably curved inwardly by such amount that, for a chord from an apex to a side end of the impact section, the distance from the midpoint of the chord to the blast-facing surface is 1-50% of the length of the chord, such as 5-30%. The V-shape is typically inwardly curved toward the interior side of the impact section. The form of the inwardly curved V-shape can optionally also be described as a gull-wing curve. The cross-sectional profile can optionally also be described as an inflexed arch shape. Such a profile advantageously has horizontal ends (at the side edge of the impact section) and a sharp apex.

Preferably, the height of the impact section is 1-30% or 10-40% of the width of the impact section. This provides as advantage that the stand-off height is smaller. Compared to a blast-protection element with an impact section having a cross-sectional profile formed by two quarter circles (with a ratio of height to width of 1:2), the stand-off height can be smaller and a better stability of the vehicle can be obtained.

Preferably, the blast-protection element comprises means for attaching the blast-protection element to a vehicle, preferably at the interior side of the impact section. The means for attaching the blast-protection element can be adapted for permanently or demountable attaching the blast-protection element to a vehicle. The means for attaching are optionally structurally integrated in the blast-protection element and/or the impact section. Examples of suitable means for attaching include adhesives and fasteners, such as for bolt holes, clamps, screws, rivets, glue.

The blast-protection element can be directly or indirectly secured to a cabin and/or a frame of vehicle, such as by welding, gluing or using fasteners such as bolts. The attaching means can also comprise integral vehicle attachment structures, such as flanges, which are adapted for interfacing with a vehicle design. Preferably, the blast-protection element comprises means for attaching to a vehicle at the apex part and/or at the side edges, for optimal membrane deformation. Reinforcement of the impact section at the apex part and/or the side edges and the corresponding parts of the vehicle frame is preferred. Preferably, the blast-protection element comprises a reinforcing frame at the apex part and/or side edges at the interior side.

Preferably, the blast-protection element comprises one or more reinforcing ribs extending at the interior side of the impact section. Such reinforcing ribs can increase the load bearing capacity and stiffness of the impact section by increasing the moment of inertia of the impact section. This is especially advantageous for an impact section which is at least partly formed from a fibre-reinforced composite, preferably a fibre metal laminate comprising a laminate of several thin metal layers bonded with layers of fibre-reinforced composite material.

Preferably, the reinforcing ribs extend in transversal direction over the width of the blast-protection element. The reinforcing ribs can accordingly reinforce the blast-protection element against deformations in transversal direction. This is preferably combined with a reinforcing frame at the apex part and/or side edge.

The height of the ribs can be typically 0.5-2 times the thickness of the impact section. The height of the ribs can also be such that the ribs span the depth of the impact section. Optionally, the ribs are monolithically part of the impact section. The blast-protection element can thus comprises one or more ribs extending across the impact section, at the interior side thereof, between two blast-guiding parts and an apex part there between.

The ribs can extend in vertical direction at the interior side of the blast-protection element from an apex part of the impact section over preferably 5-100% of the depth of the impact section, such as 5-20%. The ribs can span the depth of the impact section or even stand out from the impact section. In this way, the ribs can provide a vertical reinforcement for the apex part. Preferably, one or more ribs span the distance in vertical direction from the interior side of the impact section to the vehicle bottom. The ribs can in this way connect the apex part and the vehicle frame in use. The ribs can further comprise means for attaching or integrating the blast-protection element to the vehicle.

Figure 5:
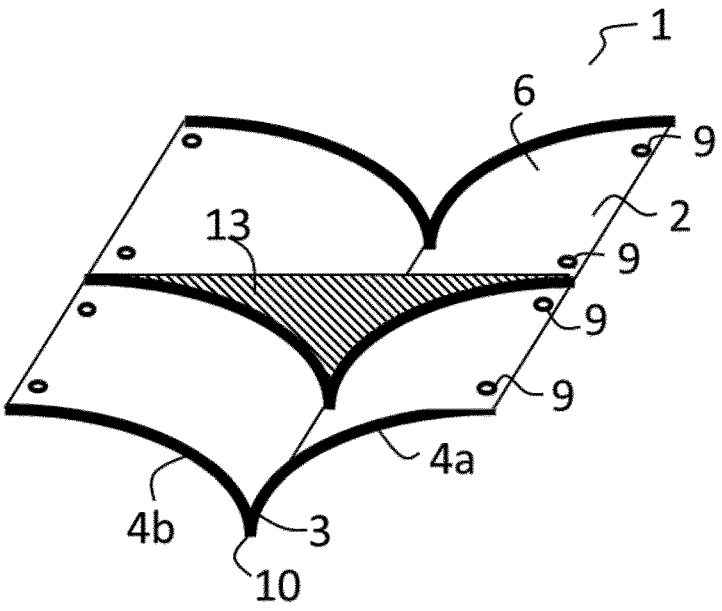
FIG. 5 is a perspective view of a blast-protection element according to the invention with a rib.

FIG. 5 shows a blast-protection element with a rib. Blast-protection element 1 comprises impact section 2 and means for attachment 9, which are bolt holes. Impact section 2 comprises apex part 3 and blast-guiding parts 4*a* and 4*b*. Blast-protection element 1 further comprises rib 13. Rib 13 spans the width of the impact section and the depth of the impact section and lies at interior side 6 of the impact section.

The apex preferably points in a blast-facing direction. The apex can thus act as a break-up structure for a blast coming from that direction. As the apex is relatively sharp (in comparison with conventional V-shape floors), the impact section can have an advantageous angle of incidence and a highly reduced coefficient of reflection. This minimises the reflection overpressure experienced in the area of the apex while creating an increased stiffness of the curved sheet at each side of the apex In a further aspect, the invention relates to a vehicle comprising a blast-protection element as described. The vehicle is preferably a land vehicle. The blast-protection element can furthermore be attached to water vehicles, buildings and other objects. Preferably, the blast-protection element is structurally integrated with the vehicle at the bottom of the vehicle. The blast-protection element can also be attached to, or integrated in, the frame of the land vehicle.

Optionally, the blast-protection element is attached to a land vehicle at the bottom of the land vehicle as a blast shield. The blast-protection element can also be attached to a side of the vehicle. The land vehicle is typically a wheeled, tracked and/or motorised land vehicle, for example an armoured land vehicle. The land vehicle can for example be an armoured motorised wheeled land vehicle, such as an MRAP (Mine-Resistant Ambush Protected) vehicle. The vehicle typically comprises a cabin with two sides, a front and a rear. The impact section preferably spans 90% or more of the length and/or width of the vehicle cabin, such as entirely.

The wheels of the vehicle can define a ground plane and the blast-protection element can be orientated such that the apex points towards the ground plane, in vertical direction. Preferably, the vehicle has a stand-off above the ground and clear space between the vehicle floor and the ground. The stand-off is preferably 50-150 cm, such as 90-110 cm, preferably at the sides of the vehicle. Due to the design of the impact section, the clear space typically increases from an apex to a side edge of the impact section, preferably the rate of increase decreases from an apex to a side edge. Preferably, the vehicle has open sides between the ground and the cabin. This allows under-vehicle blasts that are at least partly deflected to the sides to exit from under the vehicle.

Figure 6:
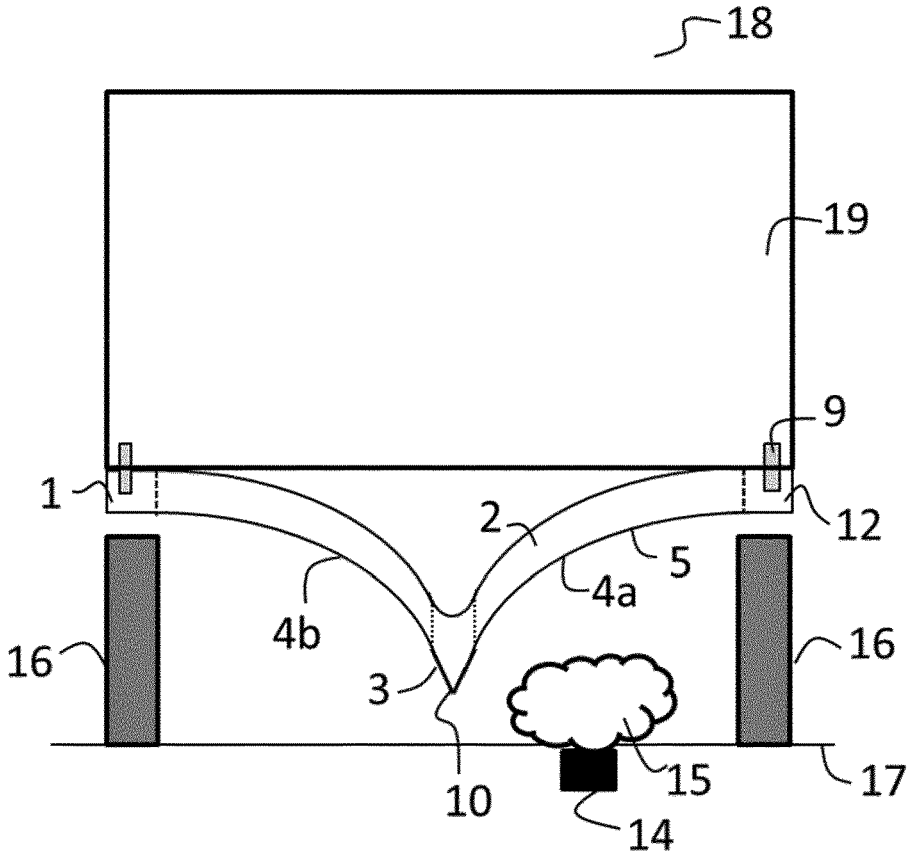
FIG. 6 is a schematic cross section of a vehicle having a blast protection element of the invention.

FIG. 6 shows a cross section of a vehicle comprising a blast-protection element. Vehicle 18 comprises cabin 19. Blast-protection element 1 comprising apex part 3 and blast-guiding parts 4*a* and 4*b* is attached to the vehicle by attachment means 9. Vehicle 18 in addition comprises wheels 16, which are also attached to the vehicle by a suspension (not shown). Vehicle 18 drives over ground plane 17 and over IED 14. This triggers a blast 15, which is deflected by blast-guiding part 4*a* and apex part 3. Apex 10 points in the direction of ground plane 17. The clear space, between ground plane 17 and blast-facing surface 5, increases from apex 10 to side edge 12 of the impact section. Apex part 3 faces blast 15 at an oblique angle, thereby reducing the reflected overpressure, while parts of the impact section 2 close to side edge 12 are perpendicular to the impact of blast 15. These parts have a higher coefficient of reflection, however the distance from the blast is larger and the reflected overpressure at these parts is not too large. The blast-protecting element 1 has improved stiffness due to the curved shape of the impact section 2 which is advantageous for protection against blasts.

In yet a further aspect, the invention relates to a method of manufacturing a land vehicle comprising a blast-protection element, comprising attaching a blast-protection element as described to a vehicle as described. The blast-protection element can be mounted or integrated into a vehicle during original manufacture of a vehicle. The blast-protection element can also be retro-fitted onto an existing vehicle, such as by welding, adhesives and/or fasteners. The blast-protection element may replace a blast-protection element of another design (e.g. a straight V-hull). The blast-protection element can be used in a method of operating a land vehicle as described, comprising driving the land vehicle, wherein a concave blast-facing surface portion of the blast-guiding parts is facing the ground. The element can be used for protection of objects against a blast, such as for protection against improvised explosive devices and/or land mines.

All references cited herein are hereby completely incorporated by reference to the same extent as if each reference were individually and specifically indicated to be incorporated by reference and were set forth in its entirety herein.

The use of the terms "a" and "an" and "the" and similar referents in the context of describing the invention (especially in the context of the claims) are to be construed to cover both the singular and the plural, unless otherwise indicated herein or clearly contradicted by context. The terms "comprising", "having", "including" and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention. For the purpose of the description and of the appended claims, except where otherwise indicated, all numbers expressing amounts, quantities, percentages, and so forth, are to be understood as being modified in all instances by the term "about". Also, all ranges include any combination of the maximum and minimum points disclosed and include and intermediate ranges therein, which may or may not be specifically enumerated herein.

Preferred embodiments of this invention are described herein. Variation of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject-matter recited in the claims appended hereto as permitted by applicable law. Moreover, any combination of the above-described elements in all possible variations thereof is encompassed by the invention unless otherwise indicated herein or otherwise clearly contradicted by context. The claims are to be construed to include alternative embodiments to the extent permitted by the prior art.

For the purpose of clarity and a concise description features are described herein as part of the same or separate embodiments, however, it will be appreciated that the scope of the invention may include embodiments having combinations of all or some of the features described.

The invention will be further elucidated by the following examples, which are not intended to be limiting the scope of protection in any way.

Example 1

Figure 7:
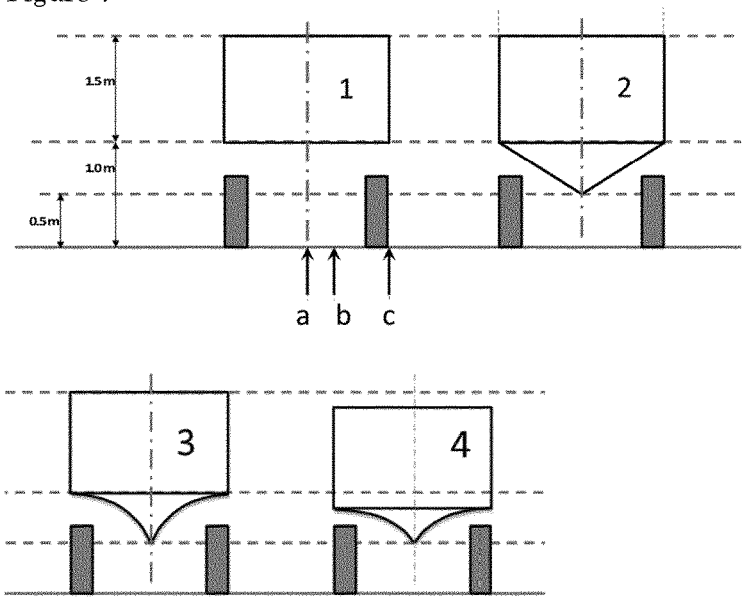
FIG. 7 is a schematic representation of blast-protection elements according to 4 designs of the invention.
Figure 8:
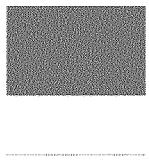
FIG. 8 is a schematic showing a front view of the blast-protection elements set forth in FIG. 7.
Figure 8:
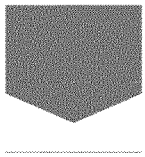
Figure 8:
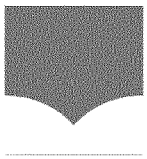
Figure 8:
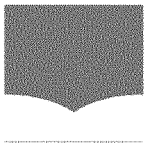

A numerical simulation was carried out to compare blast-protection elements with various designs. Four different designs (FIG. 7) were evaluated: 1. Flat floor (comparative) 2. V floor (comparative) (also: VEE) 3. Gull floor 4. Modified shallow profile Gull wing floor (also: GULL-LOW). In FIG. 7, A is position 1 (centre line), B is position 2: 0.3 m from centre line, C is position 3; 1.15 m from centre line, total width vehicle is 2.3 m. The finite element models of designs 1-4 are shown in front view in FIG. 8.

The flat floor was evaluated with a standoff of 1.0 m. The other floor designs were evaluated with a standoff of 0.5 m at the lowest point which provided a consistent cabin height for the Flat, V and Gull wing floors at 1.0 m. The Gull-low floor had the cabin floor lowered by 200 mm to 0.8 m. The standoffs are summarised as follows:

TABLE 1

| | Standoff Lowest Point [m] | Standoff of cabin floor [m] | Height of floor section [m] |
|---|---|---|---|
| Flat | 1.0 | 1.0 | 0 |
| V | 0.5 | 1.0 | 0.5 |
| Gull | 0.5 | 1.0 | 0.5 |
| Gull-low | 0.5 | 0.8 | 0.3 |

For the evaluation the dimensions of the idealised cabin and floor were: width=2.3 m; length=3.0 m; height of cabin=1.5 m; standoff for flat floor=1.0 m; standoff for other designs=0.5 m (standoff to lowest point); height of V and Gull wing floor=0.5 m; height of Gull-low wing floor=0.3 m. The properties of the idealised floor were: elastic-plastic steel, E=211 GPa; density=7850 kg/m$^3$, yield stress=1100 MPa, 20 mm thick. The properties of the idealised cabin were: rigid, density=22000 kg/m$^3$, 20 mm thick. Four blasts were used: A: 6 kg TNT (2,4,6-trinitrotoluene), centre; B: 6 kg TNT, 30 cm from centre; C: 6 kg TNT, 115 cm from centre (side of vehicle); D: CONWEP hemispherical surface, 12 kg TNT, 115 cm from centre (side of vehicle). For blasts A-C, buried sandy gravel with 100 mm depth of bury was used. Transversal offsets from the centreline were 0, 30 and 115 cm. The different floor shapes are evaluated by global and local criteria: Global (impulse transmitted from blast) and Local (deformation of the floor).

Figure 9:
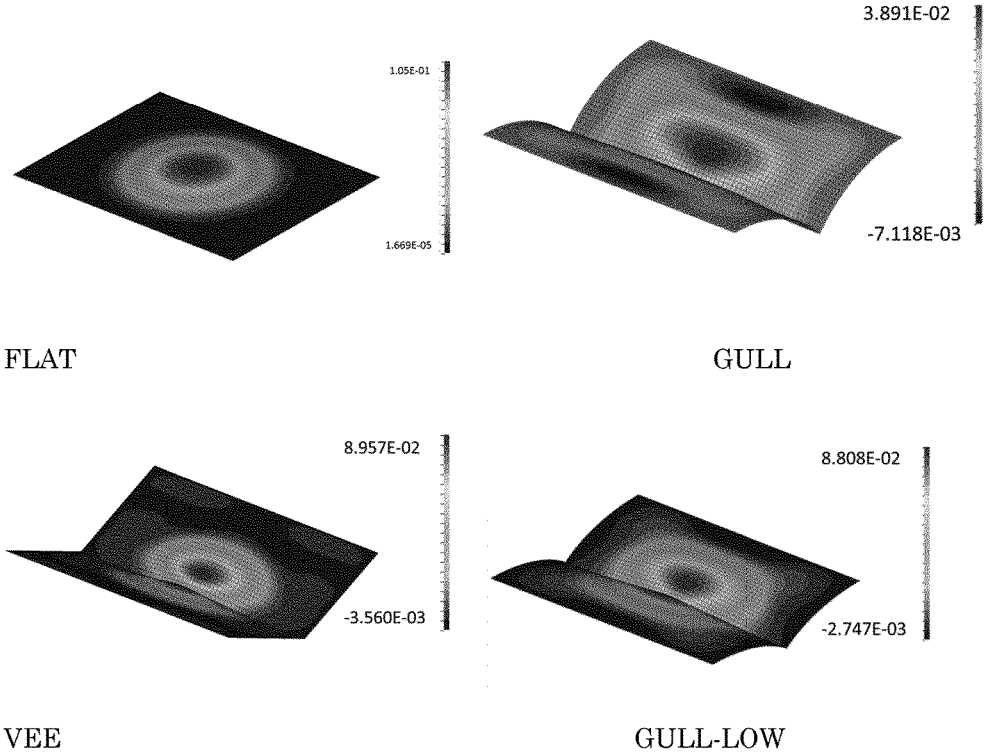
FIG. 9 provides results for local performance comparison corresponding to table 2.
Figure 10:
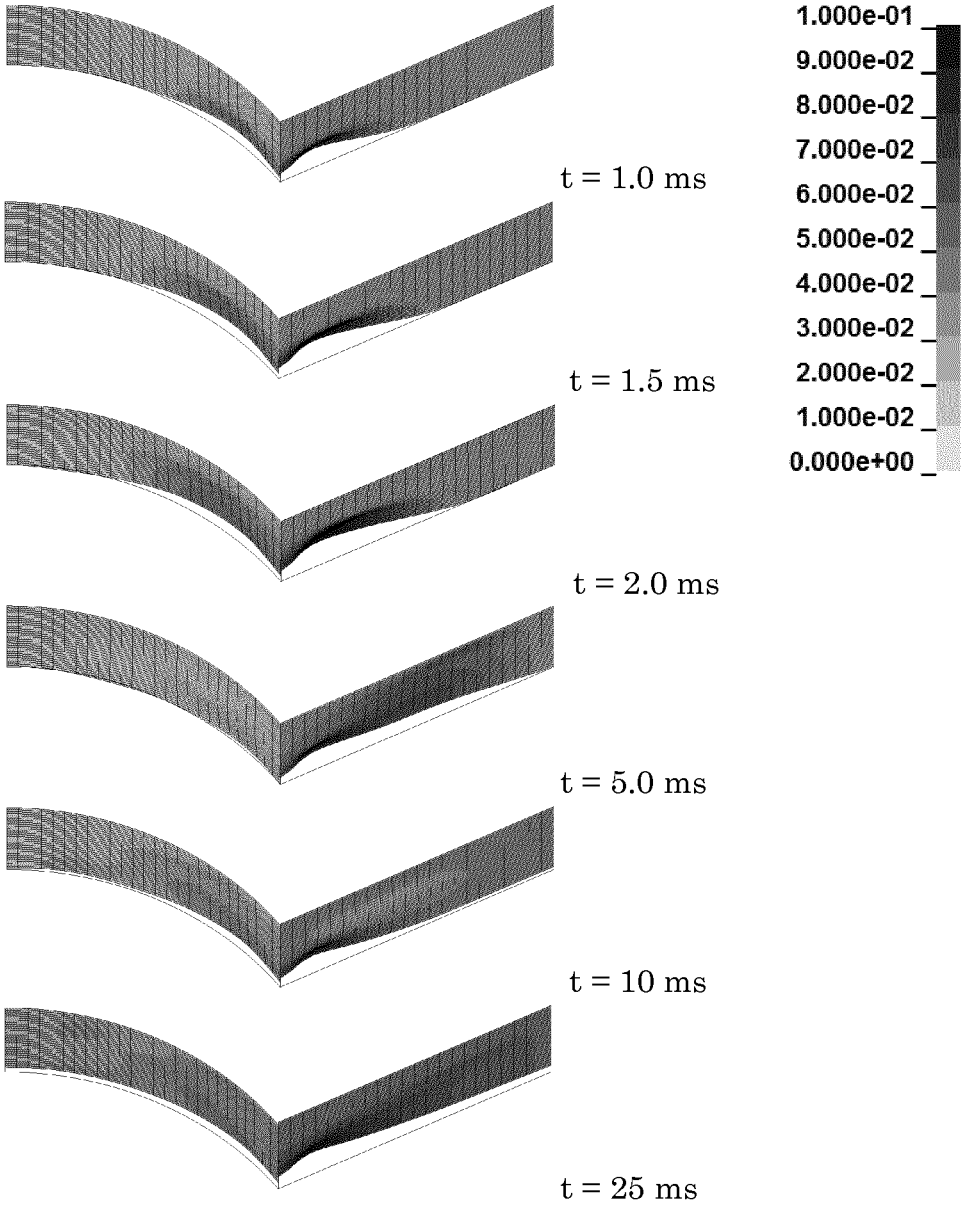
FIG. 10 is a schematic transversal cross-section of a blast-protection element according to the invention.

The results for the global criteria comparison are shown in table 2 and table 3. The results show that the gull wing floor has the best shape for reducing the impulse transmitted to the vehicle for all locations apart from the side position where a higher flat floor is better as shown in table 2 and table 3. This is due to the fact that the lowest portion of the gull wing has a sharper profile (smaller included angle) than the V floor. Therefore, the reflected pressure at this part is minimised in the gull wing floor. FIG. 10 9 shows predicted displacements of floor for different load cases. Table 3 shows the predicted transmitted global impulse. Table 2 gives predicted deformations of floors for different load cases (deflection in mm).

The results for the local performance comparison are shown in table 2 and FIG. 9. The deformation of the floors was evaluated at four different locations: 1) 0 cm (on the centreline); 2) 30 cm from the centreline; 3) 50 cm from the centreline; 4) 115 cm from the centreline (side of vehicle).

The results show that the gull wing design provides the stiffest floor section with the lowest vertical displacement of the floor for the different load cases as shown in table 2. This is due to two aspects:

1: the sharper profile of the gull wing in the centre part of the vehicle and the smaller included angle between floor and blast wave displacement direction, resulting in a more favourable sideward reflection of the blast wave, resulting in reduced transmitted impulse to the vehicle and 2: an increased stiffness because of the curved contour of the panel, being able to resist the pressure of the blast by membrane stress in the curved skin, rather than by bending stress as in a flat sheet.

The deformed geometry of the different floor types are shown FIG. 9 with deformation contours for a centrally located buried charge load case. Due to the stiffer spine section of the gull wing floor and surrounding curved profile, this design produces the lowest vertical deformation in comparison to the others under the same conditions. Fringe levels are shown (contours of vertical displacement at 2 ms). The fringe level scale differs between the panels. The reduced section gull wing also performs well in comparison to the other designs with the benefit of providing a lower cabin floor (lowered by 200 mm).

Example 2

FIG. 10 shows the results of a simulation of the deformation upon impact of a blast of a Gull wing blast-protection element according to the invention (left side) and a V-shape blast-protection element (comparative, right side). This example is the same configuration and the result of the same calculation as for example 1. The simulations differed only in the shape of the impact section. The simulation was for 25 ms using finite element analysis. FIG. 10 shows the results in transversal cross-sections through the centre of the deformed area as snapshots at 1.0, 1.5, 2.0, 5.0, 10.0 and 25.0 ms. Only half of the blast-shield is show. The two blast shields are simulated independently from each other. FIG. 10 shows the half blast-protection element side by side for ease of comparison; they are not simulated as attached to each other. The grey scale of the shading indicates the fringe levels as sheet deformation in meters. The contour of the initial shape is shown as a guide to the eye. The actual contour in each snapshot shows the deformation. FIG. 10 shows that the Gull-wing blast-protection element deformed less severe and had lower fringe levels than the V-shape blast-protection element.

TABLE 2

| | CENTRE BURIED | | | | 115 CM BURIED | | | |
|---|---|---|---|---|---|---|---|---|
| | FLAT | VEE | GULL | GL | FLAT | VEE | GULL | GL |
| CS | 1 | 1 | 1 | 0.8 | | | | |
| | 1 | 2 | 3 | 4 | 1 | 1 | 1 | 0.8 |
| J tot | 17174 | 27768 | 28495 | 27765 | 9052 | 11958 | 10525 | 12098 |
| J calc | 17174 | 16912 | 12764 | 18235 | 9052 | 13474 | 12551 | 13819 |
| P | 16868 | 15285 | 10034 | 16376 | 8636 | 12099 | 11237 | 13093 |
| Mass | 1085 | 1182 | 1219 | 1137 | 1085 | 1182 | 1219 | 1137 |
| | 10078 | 10585 | 10380 | 10257 | 10078 | 10585 | 10380 | 10257 |
| | 11163 | 11767 | 11599 | 11394 | 11163 | 11767 | 11599 | 11394 |
| V | 1.51 | 1.30 | 0.87 | 1.44 | 0.77 | 1.03 | 0.97 | 1.15 |
| Defl 0 cm | 124 | 45 | 24 | 73 | 36 | 17 | 10 | 22 |
| 30 cm | 115 | 80 | 38 | 86 | 43 | 69 | 21 | 42 |
| 50 cm | 87 | 49 | 21 | 55 | 47 | 75 | 20 | 39 |
| 115 cm | 63 | 52 | 31 | 59 | 61 | 54 | 56 | 80 |
| V 0 cm | 136 | 56 | 25 | 60 | 33 | 14 | 15 | 24 |
| 30 cm | 88 | 81 | 52 | 88 | 42 | 36 | 17 | 31 |

TABLE 2-continued

| | | | | | | | | |
|---|---|---|---|---|---|---|---|---|
| 50 cm | 55 | 36 | 21 | 43 | 53 | 58 | 24 | 42 |
| 115 cm | 2.8 | 1.82 | 1.6 | 2.25 | 1.85 | 1.89 | 2.1 | 2.6 |

| | 30 CM BURIED | | | | 115 CM DETONATION | | | |
|---|---|---|---|---|---|---|---|---|
| | FLAT | VEE | GULL | GL | FLAT | VEE | GULL | GL |
| CS | 1 | 1 | 1 | 0.8 | 1 | 1 | 1 | 0.8 |
| J tot | 16959 | 26571 | 26194 | 26338 | | | | |
| J refl | 16959 | 18691 | 16406 | 20711 | | | | |
| P | 16625 | 16935 | 13414 | 18919 | 12198 | 12163 | 12750 | 12892 |
| Mass | 1085 | 1182 | 1219 | 1137 | 1085 | 1182 | 1219 | 1137 |
| | 10078 | 10585 | 10380 | 10257 | 10078 | 10585 | 10380 | 10257 |
| | 11163 | 11767 | 11599 | 11394 | 11163 | 11767 | 11599 | 11394 |
| V | 1.49 | 1.44 | 1.16 | 1.66 | 1.09 | 1.03 | 1.10 | 1.13 |
| Defl 0 cm | 89 | 72 | 47 | 109 | 59 | 15 | 14 | 23 |
| 30 cm | 100 | 161 | 84 | 158 | 51 | 60 | 29 | 41 |
| 50 cm | 89 | 112 | 33 | 85 | 42 | 66 | 24 | 34 |
| 115 cm | 81 | 50 | 28 | 70 | 62 | 46 | 48 | 62 |
| V 0 cm | 88 | 62 | 46 | 78 | 29 | 8 | 17 | 20 |
| 30 cm | 136 | 170 | 106 | 164 | 32 | 32 | 27 | 33 |
| 50 cm | 92 | 77 | 49 | 88 | 37 | 46 | 25 | 34 |
| 115 cm | 2.9 | 2.1 | 1.4 | 2.3 | 2 | 1.8 | 1.84 | 2.1 |

CS: corner standoff (m),
J tot: total impulse (Ns),
J calc: calculated impulse,
J refl: reflected impulse,
P: momentum (Ns)
V: velocity (m/s)
Defl: deflection/displacement (mm) at 0 cm (centre) to 115 cm (side),
GL: Gull-Low

TABLE 3

| Global Impulse (Ns) | FLAT | VEE | GULL | GULL-LOW |
|---|---|---|---|---|
| 0 cm 6 kg buried | 16868 | 15285 | 10034 | 16376 |
| 30 cm 6 kg buried | 16625 | 16935 | 13414 | 18919 |
| 115 cm 6 kg buried | 8636 | 12099 | 11237 | 13093 |
| 115 cm-12 kg hemispherical surface CONWEP | 12198 | 12163 | 12750 | 12892 |

The invention claimed is:

1. A blast-protection element for protecting a vehicle against a blast, said blast-protection element comprising:

a deformable impact section, wherein said impact section comprises a blast-facing surface, at least one apex part and at least two blast-guiding parts, wherein said blast-guiding parts extend at opposed sides of said apex part and terminate at opposing ends, wherein a) said apex part comprises a protruding apex in said blast-facing surface wherein b) said at least two blast-guiding parts each comprise a concave portion of said blast-facing surface, wherein c) the blast guiding parts in total span at least 75% of the width of the impact section, wherein d) more than 90% of the blast-facing surface of each of said blast-guiding parts is concave, wherein e) said blast-facing surface of said impact section defines a transversal cross-sectional profile comprising said apex between two profile sections corresponding to two of said blast-guiding parts, wherein f) said two concave profile sections define an angle outwardly around said apex of more than 180°, wherein g) said apex is positioned in a center part of said transversal cross-sectional profile, and wherein h) the opposing ends of the concave blast-guiding parts and the apex define a triangle, said triangle having an included angle at the apex of 60° to less than 180°.

2. A blast-protection element according to claim 1, wherein each of the blast guiding parts can, at least partially, deform as a concave membrane under external blast loading.

3. A blast-protection element according to claim 1, wherein said transversal cross-sectional profile is concave over more than half of the arc length of said transversal cross-sectional profile.

4. A blast-protection element according to claim 1, wherein said blast-facing surface of said impact section defines a transversal cross-sectional profile having the general form of an inwardly curved V-shape.

5. A blast-protection element according to claim 1, wherein the blast-facing surface of the impact section has, in a region adjacent to an apex wherein the vertical distance between the blast-facing surface and the apex is less than 25% of the height of the impact section, an angle of incidence with a blast wave propagating in vertical direction of 45° or more.

6. A blast-protection element according to claim 1, wherein the blast-facing surface of the impact section has, in a region adjacent to an apex wherein the vertical distance between the blast-facing surface and the apex is less than 25% of the height of the impact section, an angle of incidence with a blast wave propagating in vertical direction of 60° or more.

7. A blast-protection element according to claim 1, wherein the height of the impact section, is more than 30% of the width of the impact section.

8. A blast-protection element according to claim 1, comprising means for attaching the blast-protection element to a vehicle.

9. A blast-protection element according to claim 1, wherein said impact section comprises an interior side opposite said blast-facing surface and wherein said blast-protection element comprises one or more reinforcing ribs extending at the interior side of the impact section.

10. A blast-protection element according to claim 9, wherein said impact section is at least partly formed from a fibre-reinforced composite.

11. A blast-protection element according to claim 9, wherein said impact section is at least partly formed from a fibre metal laminate comprising a laminate of several thin metal layers bonded with layers of fibre-reinforced composite material.

12. A blast-protection element according to claim 1, wherein said apex points in a blast-facing direction.

13. A blast-protection element according to claim 1, wherein the impact section is formed from a composite material.

14. A blast-protection element according to claim 1, wherein the impact section is formed from a material comprising a metal or alloy.

15. A blast-protection element according to claim 1, wherein the impact section is formed from a fibre metal laminate comprising a laminate of several thin metal layers bonded with layers of fibre-reinforced composite material.

16. A land vehicle comprising a blast-protection element according to claim 1.

17. A method of manufacturing a land vehicle, comprising attaching a blast-protection element according to claim 1 to a vehicle.

* * * * *